US006038831A

United States Patent [19]

Nava

[11] Patent Number: 6,038,831

[45] Date of Patent: Mar. 21, 2000

[54] APPARATUS FOR PACKAGING PRODUCTS IN OPEN OR CLOSED BOXES, STARTING FROM A FLAT PAPERBOARD MATERIAL

[76] Inventor: Vito Giovanni Nava, Via Piazzalunga, 30, 24015 San Giovanni Bianco, Bergamo, Italy

[21] Appl. No.: 08/984,837

[22] Filed: Dec. 4, 1997

[30] Foreign Application Priority Data

Dec. 19, 1996 [IT] Italy ..... MI96A2676

[51] Int. Cl.[7] ..... B65B 11/08

[52] U.S. Cl. ..... 53/207; 53/209; 53/543

[58] Field of Search ..... 493/478, 479; 53/207, 209, 543, 389.1

[56] References Cited

U.S. PATENT DOCUMENTS

| | | | |
|---|---|---|---|
| 3,527,336 | 9/1970 | Johnston | 493/479 X |
| 3,543,474 | 12/1970 | Hasselo et al. | 53/209 X |
| 3,844,088 | 10/1974 | McDonough et al. | 53/389.1 X |
| 4,034,658 | 7/1977 | Sherman | 493/177 |
| 4,569,182 | 2/1986 | Leuvering | 53/207 X |
| 4,571,916 | 2/1986 | Meuwly et al. | 53/209 X |
| 4,642,967 | 2/1987 | Culpepper | 53/209 X |
| 4,683,705 | 8/1987 | Meives et al. | 53/207 X |
| 4,793,117 | 12/1988 | Raudat et al. | 53/209 X |
| 5,148,654 | 9/1992 | Kisters | 53/209 X |

*Primary Examiner*—Linda Johnson
*Attorney, Agent, or Firm*—Bucknam and Archer

[57] ABSTRACT

An apparatus for packaging products in open or closed boxes, starting from a flat paperboard material, comprises a paperboard sheet removing assembly for successively removing individual paperboard die-cut sheets, to be supplied to an upward conveyor, supplying the paperboard sheets to a supplying line provided for supplying products to be packaged, which is arranged downward of a product separating device, the products being delivered by a product delivery device, the paperboard sheet being supplied to the line along a direction corresponding to the delivered product displacement direction, and a box forming assembly provided with a bending assembly for bending side flaps and top and bottom flaps of the boxes being formed being moreover provided.

7 Claims, 17 Drawing Sheets

APPARATUS FOR PACKAGING PRODUCTS IN OPEN OR CLOSED BOXES, STARTING FROM A FLAT PAPERBOARD MATERIAL

BACKGROUND OF THE INVENTION

The present invention relates to an apparatus for packaging products in open or closed boxes, starting from a flat paperboard material.

As is known, for packaging loose products, such as tins, bottles, cans and the like, flat paperboard sheets are conventionally used, said paperboard sheets being so shaped as to provide a desired tray or closed box configuration.

An apparatus using such a packaging is disclosed, for example, in the document DE-3 515 248 which illustrates a paperboard sheet which is horizontally arranged at a loading region, where one of the side flaps, horizontally arranged, is preliminarily bent to a vertical position.

The article assembly is displaced perpendicularly to the side flap toward the base panel and is arranged on said panel.

Then, the other side panel is upward bent, whereas the flaps are inwardly bent.

The thus formed package is driven toward the side panel, which has been raised at first, and which is arranged perpendicular to the article being packaged inlet direction.

This apparatus causes a variation of the driving or supplying direction, which greatly hinders a quick operation of the apparatus, since the articles to be packaged must be temporaneously held in a stop position, which requires a comparatively long time due to the article stop time and the deceleration and acceleration times.

Moreover, the above disclosed apparatus requires specifically designed supporting elements in order to lock the flaps against the package, after having inwardly bent said flaps, to allow the glueing material to cure to provide a firm connection.

It should be apparent that all the disclosed additional devices greatly add to the cost of the apparatus.

The document U.S. Pat. No. 4,571,916 discloses a packaging apparatus in which the paperboard sheets are supplied simultaneously with the articles to be packaged in the same supplying direction.

After having arranged the articles on the base panel, and with the articles and paperboard sheets being driven, the front and rear flaps are upwardly bent through 90° and then are correspondingly bent the side panels to cause said side panels to be vertically arranged.

Such an apparatus must necessarily comprise specifically designed implements for handling the panels and flaps, which implements are driven along the conveyor belt together with the package, in order to hold each element in its set position, to allow the glue material to properly cure.

The above apparatus is very complex construction wise and, moreover, its cost is comparatively high.

The document U.S. Pat. No. 3,844,088 provides a solution in which the finished package is driven away in the same direction in which the paperboard sheet is supplied to the apparatus loading region, fixed bending implements being provided for upwardly bend the side walls or panels.

Even in this case it is necessary to provide a clamping device, like that shown in the document DE 3 515 248, for holding the package together to allow the glue material to properly cure.

The document CH 478 026 discloses a packaging system provided for packaging multiple articles, in which the packaging paperboard sheet is upwardly bent according to a "U" shape, with the flaps or legs raised to a position perpendicular to the driving or supplying direction.

This apparatus comprises two specifically designed devices for closing the end portions of the package, each of said devices comprising two closing elements for closing the largest panels.

These closing elements, in particular, must be designed for movement along the conveyor belt, in order to make the package.

Accordingly, the packaging process requires a comparatively long time and is very complex.

The document U.S. Pat. No. 5,149,654 discloses a packaging apparatus in which the side flaps are prebent, after having raised the paperboard sheets.

The base flaps are pre-bent upwardly through 45–80° and are held in this position by means of lever elements, and then the side panels are upwardly bent through 90°; finally, the top and front base flaps are pressed together with the base and rear top flaps of the preceding package and being held in this condition to allow the glue material to cure.

This packaging process too is very long, complex and expensive.

Moreover, for changing the paperboard sheet size, it is necessary to perform comparatively long and complex operations.

SUMMARY OF THE INVENTION

Accordingly, the aim of the present invention is to overcome the above mentioned drawbacks, by providing an apparatus for packaging products or articles in open or closed boxes, starting from a flat paperboard sheet material, allowing to provide a very high packaging speed, of the order of 60–80 packs or packages per minute, starting from a not pre-glued or pre-processed flat paperboard sheet material.

Within the scope of the above mentioned aim, a main object of the present invention is to provide such a packaging apparatus allowing to change the paperboard size in a very simple and quick manner, without requiring complex adjustments or substantial modifications of the packaging apparatus.

Another object of the present invention is to provide such a packaging apparatus, for packaging loose products or articles in open or closed boxes, starting from a flat paperboard sheet material, which allows to greatly reduce the packaging cost, while providing a very high reliability of operation.

Yet another object of the present invention is to provide such a packaging apparatus for packaging products or articles in open and closed boxes which can be easily made starting from easily commercially available elements and materials and which, moreover, is very competitive from a mere economic standpoint.

According to one aspect of the present invention the above mentioned aim and objects, as well as yet other objects, which will become more apparent hereinafter, are achieved by a packaging apparatus for packaging products in open or closed boxes, starting from a flat paperboard sheet material, characterized in that said packaging apparatus comprises a paperboard sheet removing assembly for successively removing individual paperboard die-cut sheets to be supplied to a paperboard sheet supplying conveyor communicating with a product to be packaged supplying line arranged downstream of a product separating device which receives said products from a product delivery device, said paperboard sheets being supplied to said line along a supplying direction corresponding to the displacing direction of the delivered products, said apparatus further comprising a box forming assembly including a bending device for bending the side flaps and the top and bottom flaps.

BRIEF DESCRIPTION OF THE DRAWINGS

Further characteristics and advantages of the present invention will become more apparent hereinafter from the following detailed disclosure of a preferred, though not exclusive, embodiment of a packaging apparatus for packaging products in boxes, either open or closed, starting from a flat paperboard sheet material, which is illustrated, by way of an indicative, but not limitative, example in the figures of the accompanying drawings, where.

DESCRIPTION OF THE PREFERRED EMBODIMENTS

Figure 1:
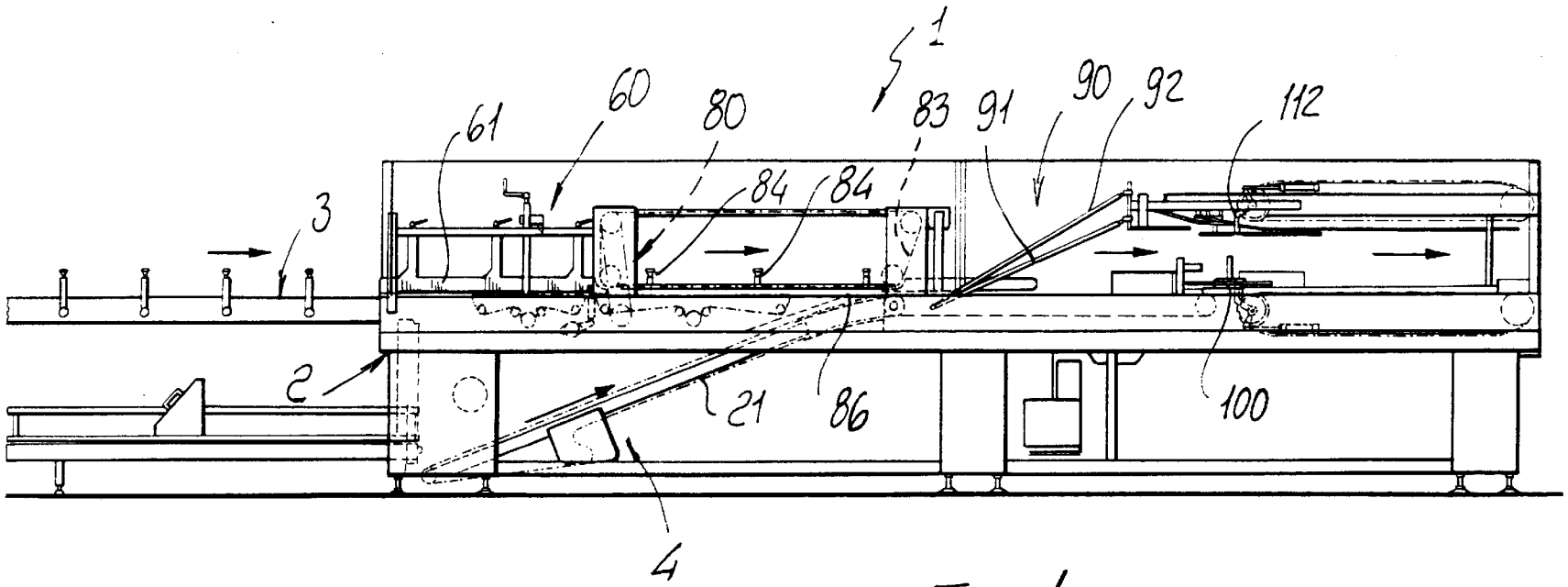
FIG. 1 is a schematic front elevation view illustrating the packaging apparatus according to the present invention.
Figure 2:
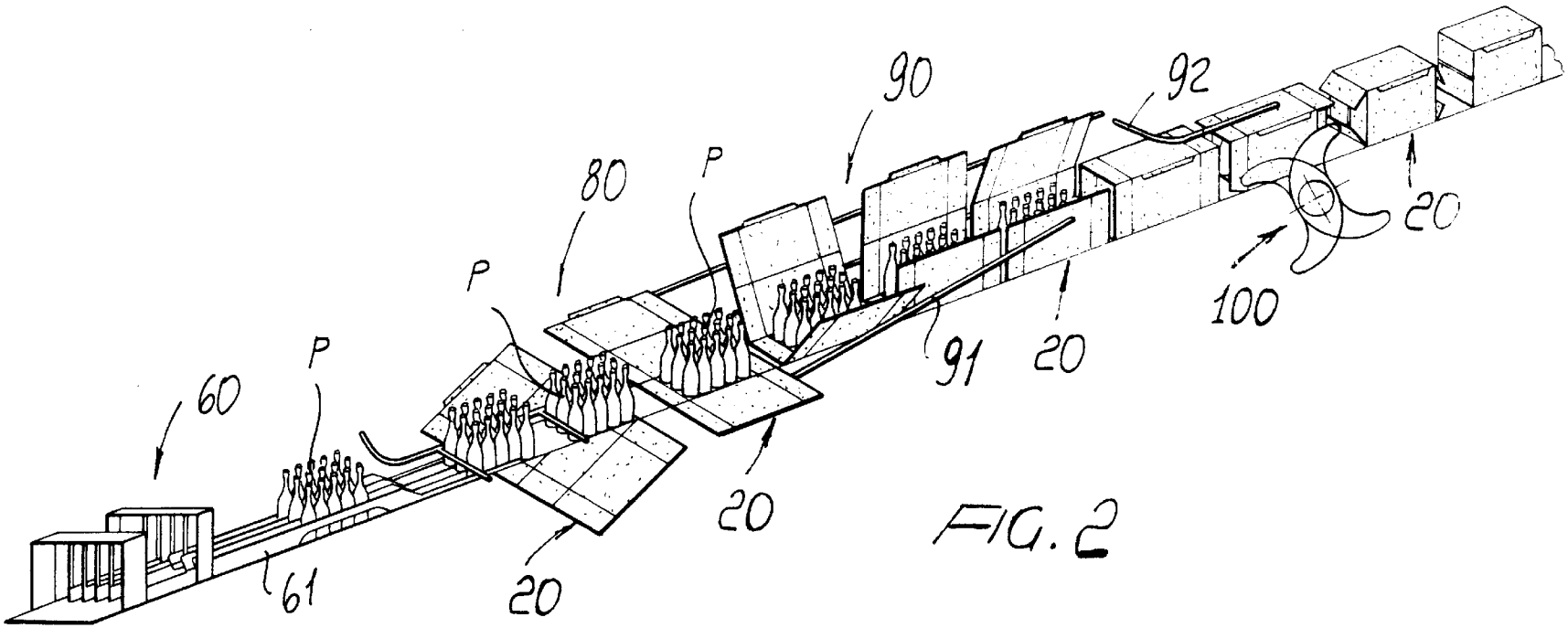
FIG. 2 schematically and sequentially illustrates the operating steps of the packaging apparatus according to the invention.

With reference to the above mentioned figures, the apparatus for packaging products or articles in open or closed boxes, starting from a flat paperboard sheet material, according to the present invention, and which has been generally indicated by the reference number 1, comprises a bearing framework, generally indicated by the reference number 2, which defines on the top thereof a product "P" supplying line 3 and, at the bottom portion thereof, a paperboard sheet removing assembly, generally indicated by the reference number 4, which is connected, as it will be disclosed in a more detailed manner hereinafter, to the product supplying line.

The rotary paperboard sheet removing device shown in FIGS. 7 to 12 is substantially constituted by a shaft 10 which transversely supports a plurality of arms 11 in turn supporting at their end portions a plurality of suckers 12.

The supporting shaft 10 is coupled to driving assemblies 13, which support the end portions of said supporting shaft 10 and are coupled to the shoulders 14 of the apparatus.

Figure 10:
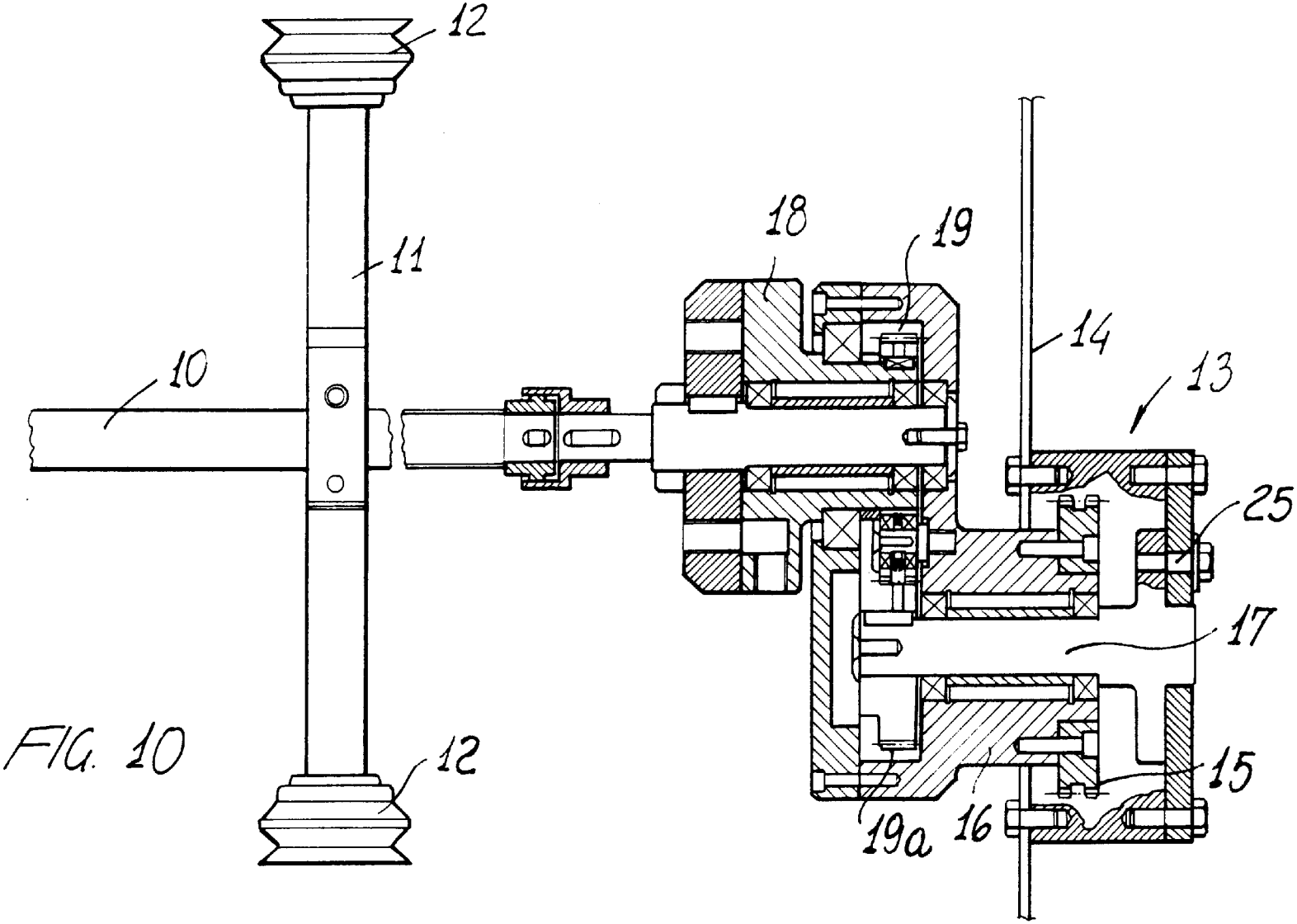
FIG. 10 is a cross-sectional view illustrating a supporting shoulder of the rotary paperboard sheet removing device.
Figure 11:
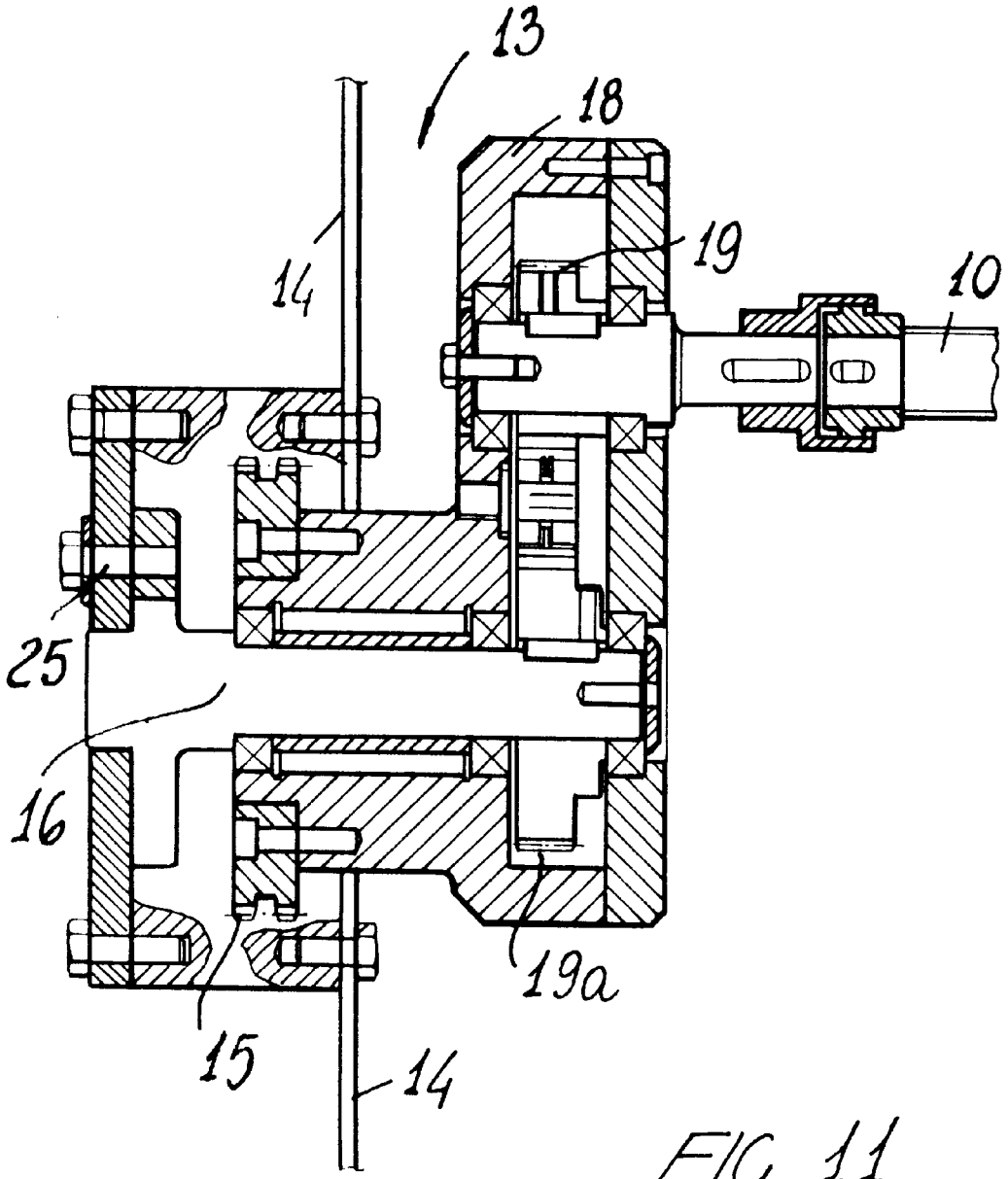
FIG. 11 is a further cross-sectional view illustrating another supporting shoulder supporting the rotary paperboard sheet removing device.
Figure 12:
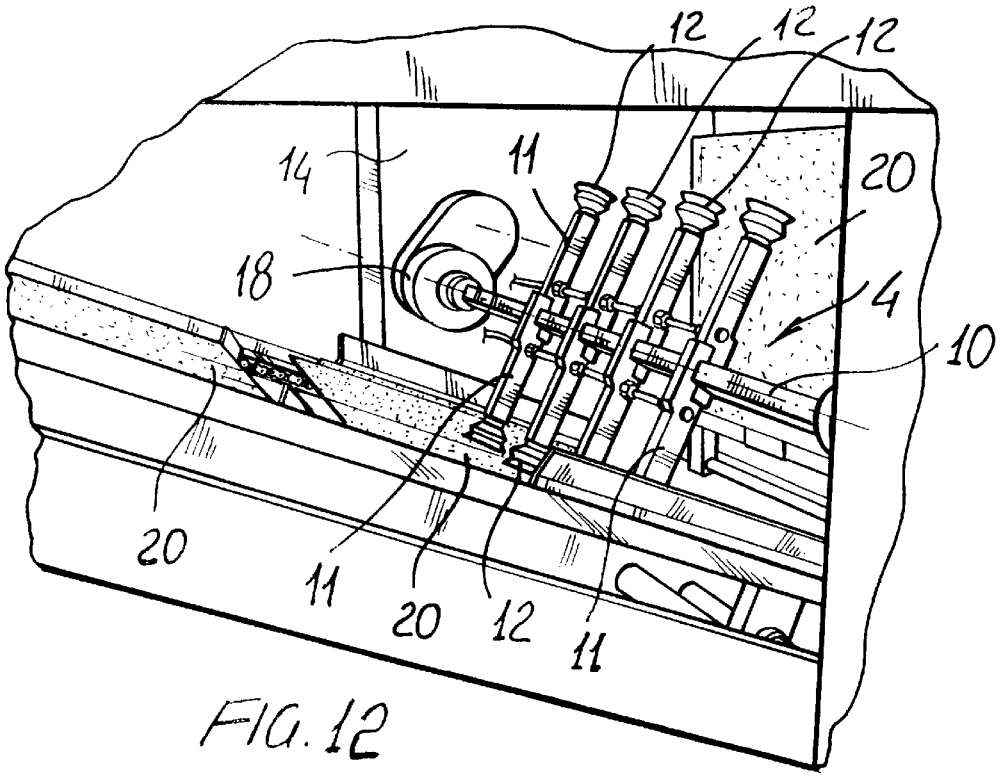
FIG. 12 is a schematic perspective view illustrating the rotary paperboard sheet removing device.
Figure 16:
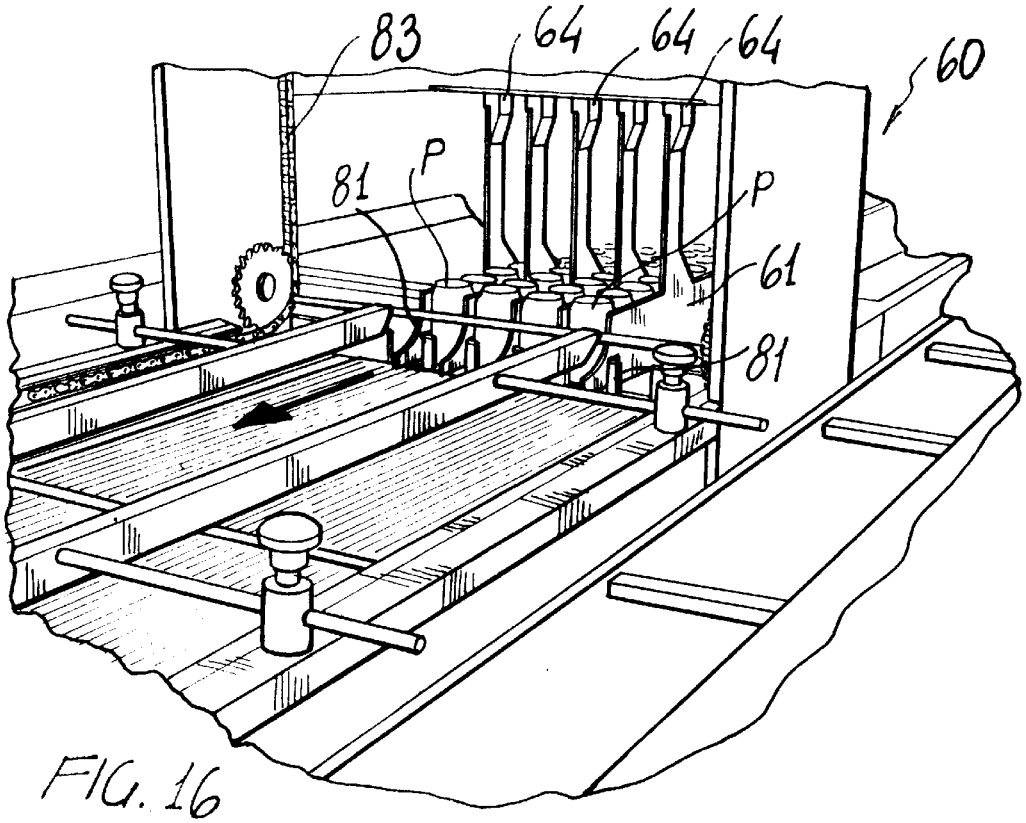
FIG. 16 is a further schematic perspective view illustrating the product delivery device.

The driving assemblies 13, as is clearly shown in FIG. 10, comprise a driven ring gear 15, which is coupled to a bushing 16, which can turn about a first fixed axis 17 parallel to the supporting shaft 10.

The bushing 16 is rigidly coupled to a supporting body 18, which rotatably supports the supporting shaft 10, on which is keyed a first pinion 19 meshing with a second pinion 19*a* rigid with the first axis or axle 17.

Thus, the assembly can be clockwise turned and, in particular, the body 18 can be correspondingly turned about the first axis or axle 17, whereas the supporting shaft 10 will turn in an opposite direction about the rotary axis thereof.

Thus, the paperboard sheet, generally indicated by the reference number 20, is removed from the paperboard sheet stack or magazine and is arranged on the paperboard sheet raising conveyor belt 21.

Figure 4:
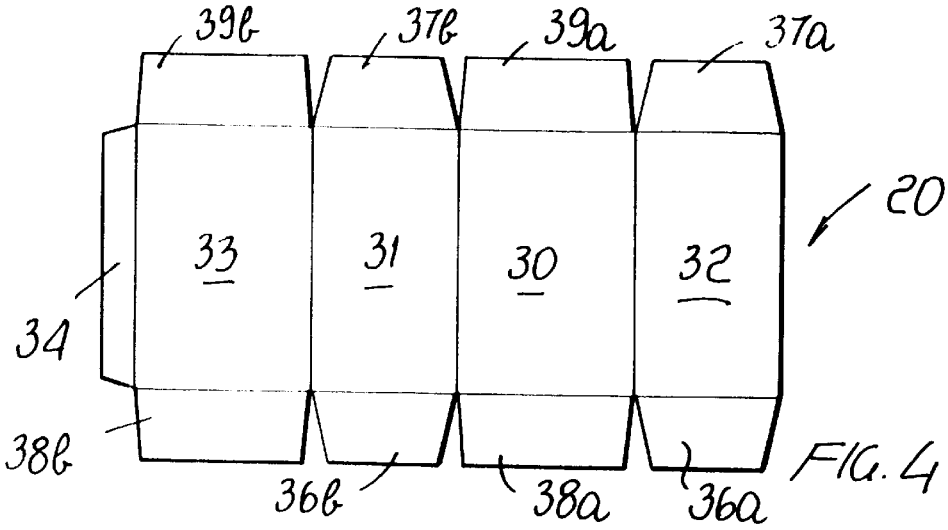
FIGS. 4, 5 and 6 illustrate, by top plan views, the paperboard die-cut sheets used for making closed or open boxes.
Figure 5:
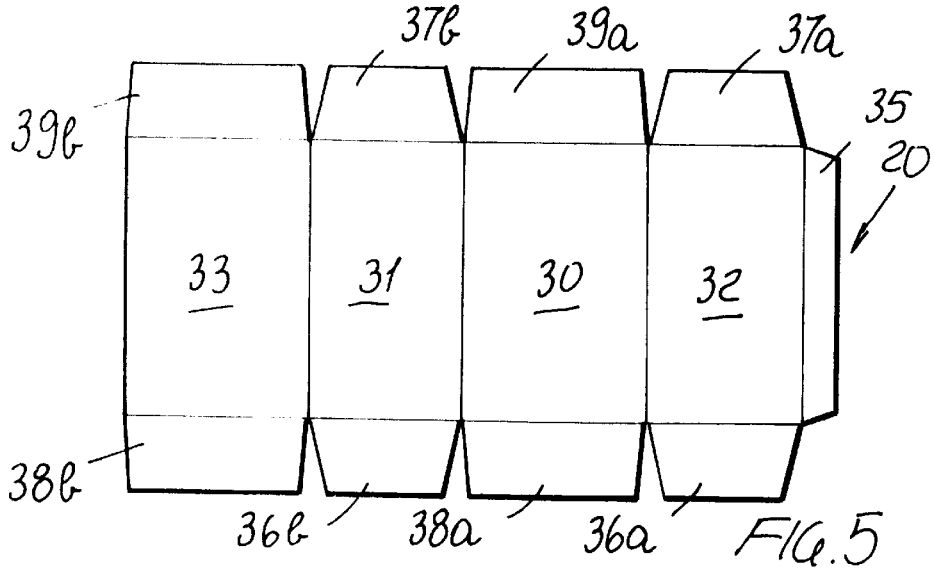
Figure 6:
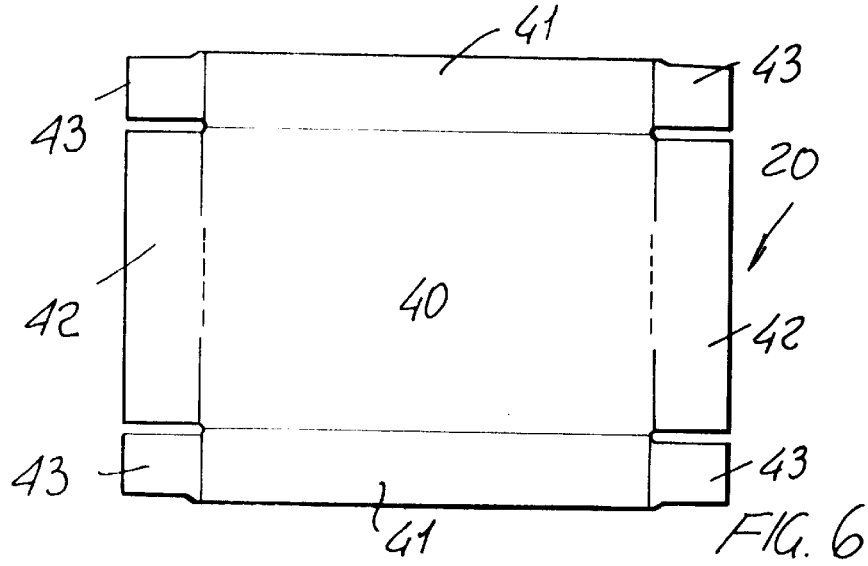
Figure 7:
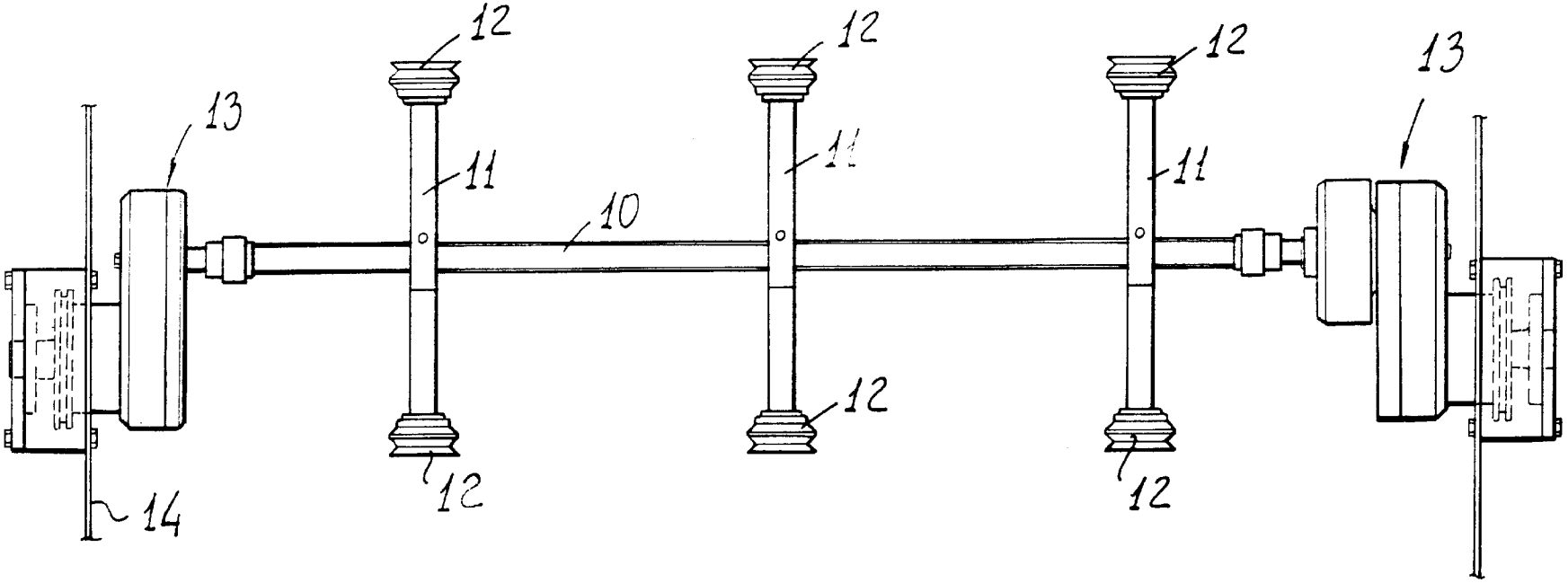
FIG. 7 is a front elevation view illustrating a rotary paperboard sheet removing device.
Figure 9:
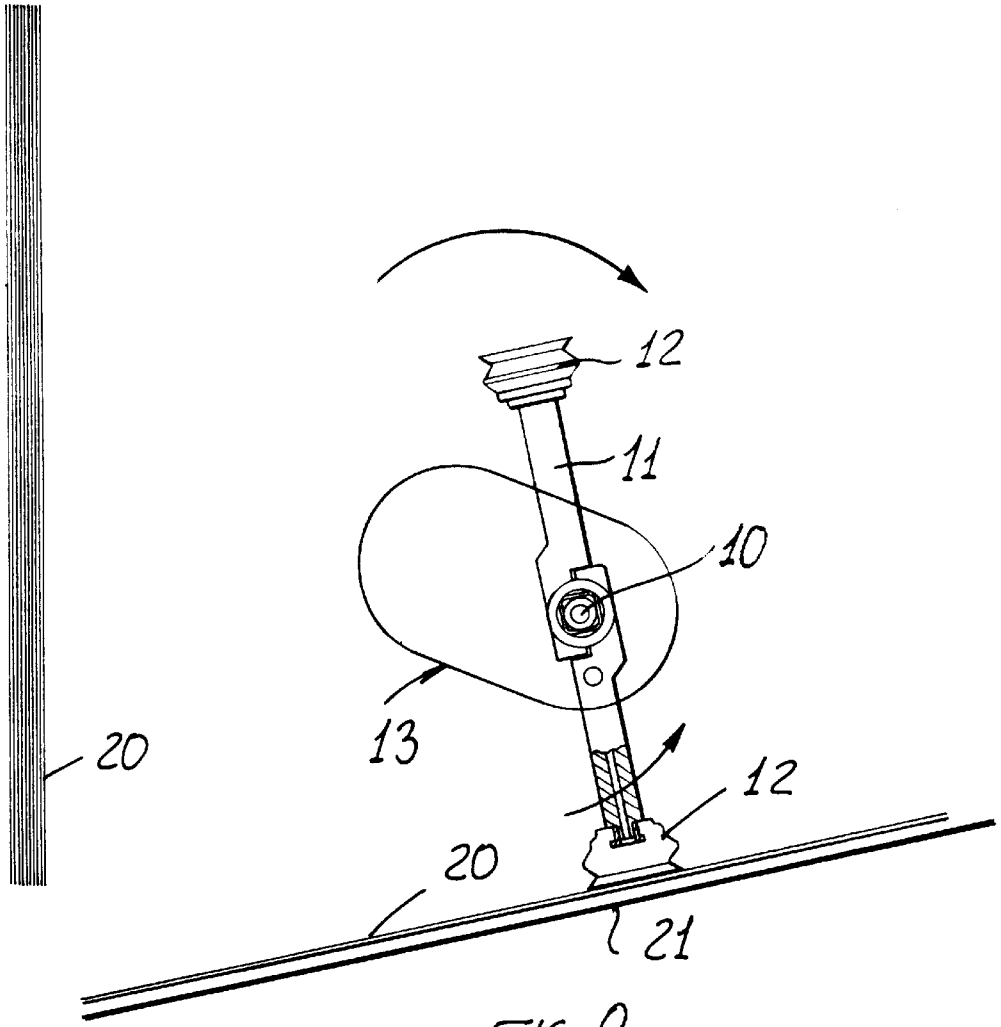
FIG. 9 illustrates an operating step in which a single paperboard sheet is arranged on a paperboard sheet raising conveyor.
Figure 8:
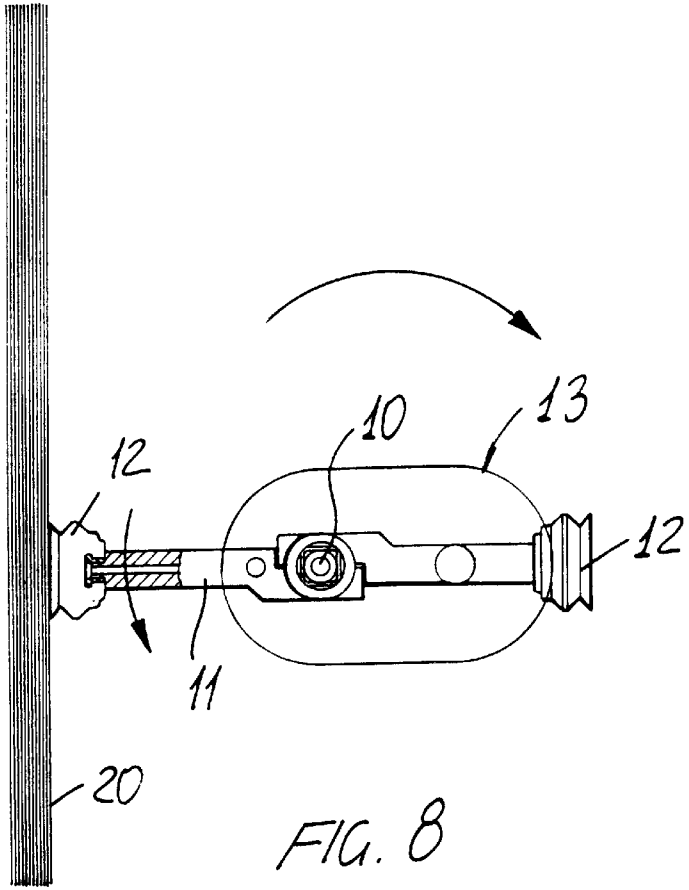
FIG. 8 illustrates that same paperboard sheet removing device during the removal of a paperboard sheet from a paperboard sheet stack.

The paperboard sheets 20, as is schematically shown in FIGS. 4 to 6, can have any desired configuration.

In particular, FIGS. 4 and 5 illustrates paperboard sheet for making closed boxes, provided with a bottom 30, adjoining side walls 31 and 32, one of which is coupled to a top element 33.

Moreover, a central wing or flap 34 is provided, which is coupled to the top element, or a central flap or wing 35 coupled to a side wall being provided.

To the side walls 31 and 32 are coupled front side flaps or wings 36*a* and 36*b* as well as rear side flaps 37*a* and 37*b*, whereas to the bottom 30 and to the top element 33 are coupled top flaps and front flaps 38*a* and 38*b*, as well as bottom and top rear flaps 39*a* and 39*b*.

With reference to the embodiment being shown in FIG. 6, are moreover provided a bottom 40, adjoining side walls 41 as well as head walls 42 which can be coupled to the coupling tongues 43, engaged with the side walls.

In this connection it should be apparent that the type of paperboard sheet can be changed depending on the specific requirements.

The above disclosed rotary paperboard sheet removing device comprises a timing screw 25, allowing the gear assembly and supporting shaft to be rotated in order to provide a set or desired suction timing.

In fact, by screwing off the timing screw 25, the supporting assembly 18 and supporting shaft 10, together with the pinions 19 and 19a can be turned for a set phase angle with respect to the driving assembly 13, and this phase-adjusted position can be "set" by further screwing on the timing screw 25.

Figure 13:
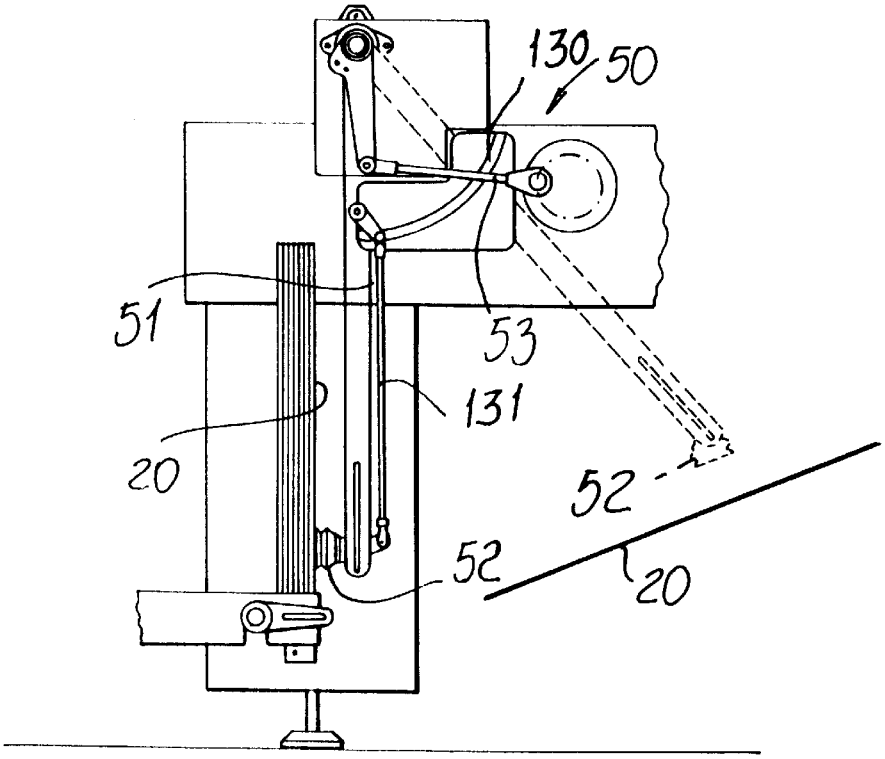
FIG. 13 is a side view illustrating another paperboard sheet removing device.
Figure 14:
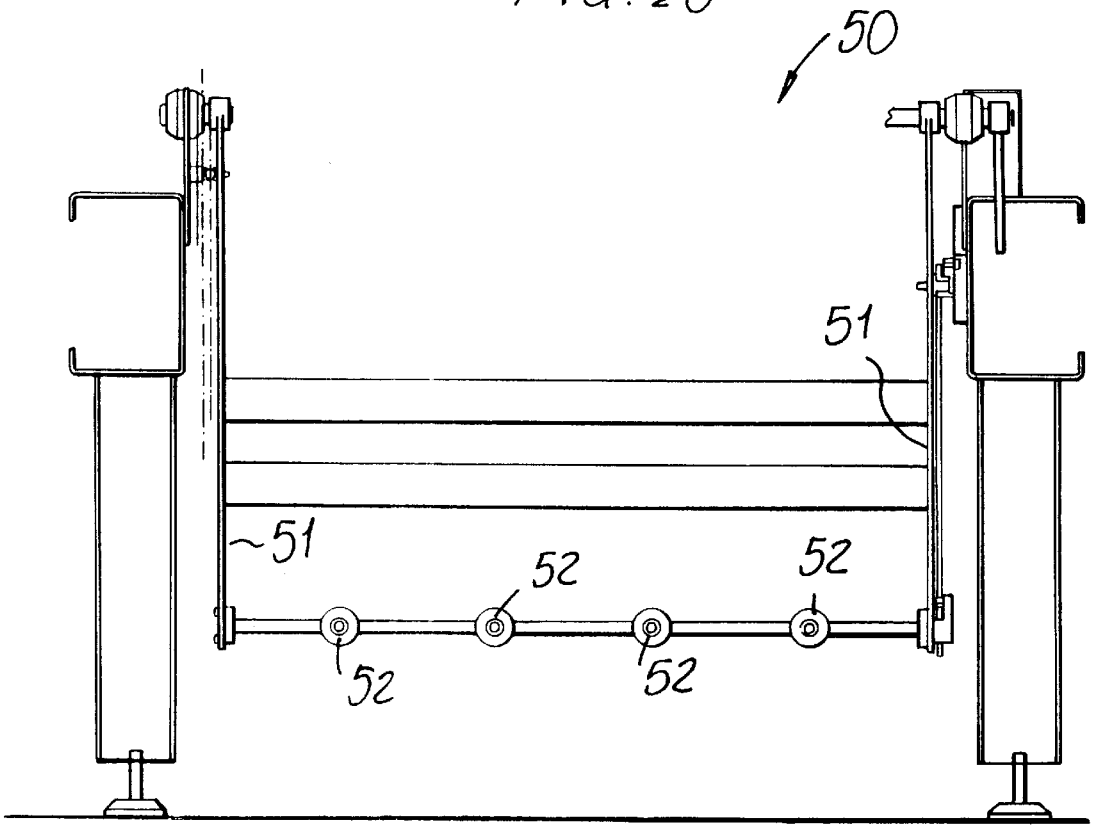
FIG. 14 illustrates said another paperboard sheet removing device, as seen from the front thereof.
Figure 15:
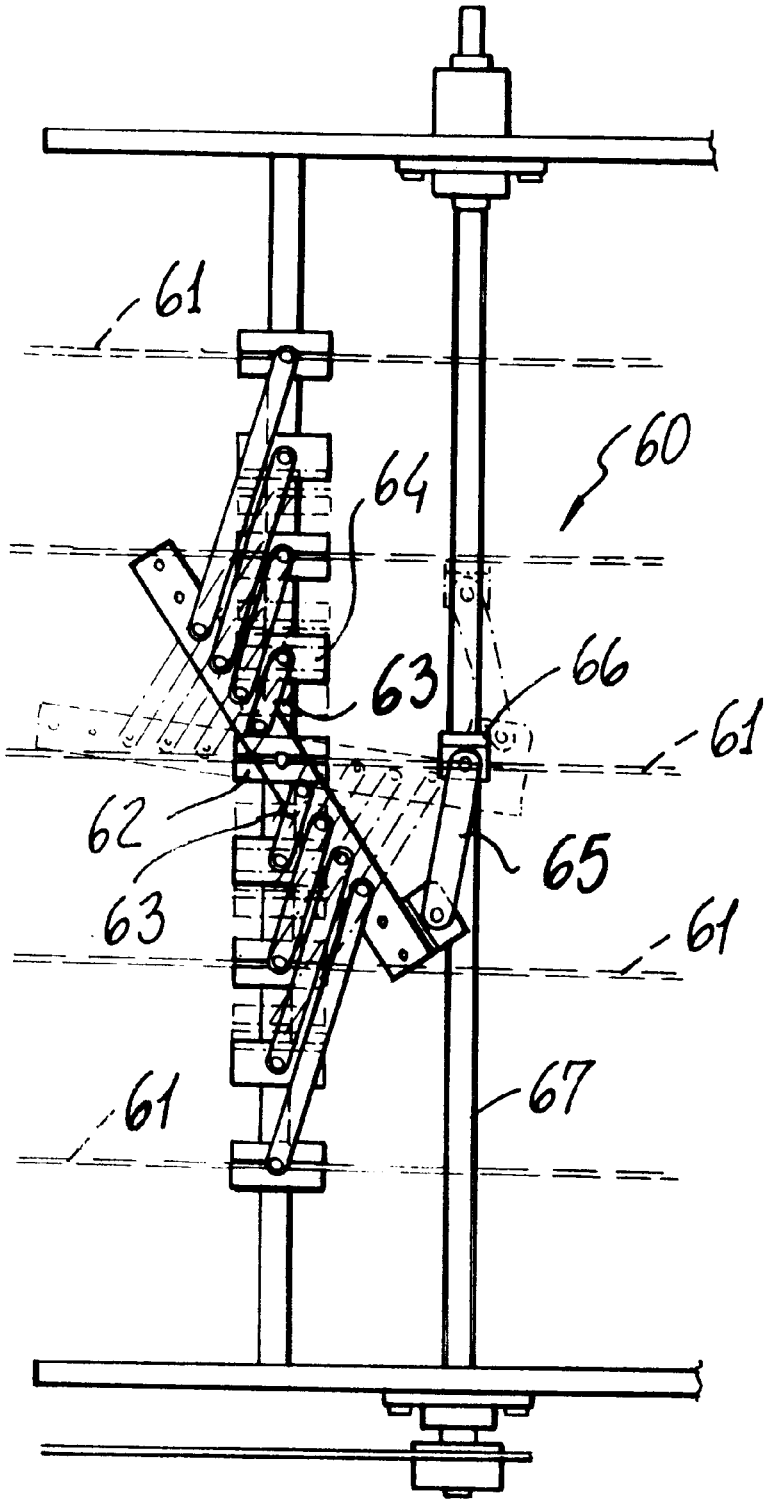
FIG. 15 is a top plan view illustrating an assembly for changing the positions of bulkhead elements and of the bottom belts of the product or article delivery device.

The rotary paperboard sheet removing device will allow to obtain a very high production yield, and, in the case of smaller operating speeds, it will be possible to use a modified paperboard sheet removing device, shown in FIGS. 13 and 14 and which has been generally indicated by the reference number 50 and substantially comprising a swinging lever 51 pivoted at the top thereof and supporting bottom suckers 52 engaging with the paperboard sheets, also indicated by 20.

The suckers 52 are driven and rotated by the driving cam 130 through a small rod 131 so as to arrange the paperboard sheet perpendicular to the paperboard sheet raising direction.

The lever 51 is driven by a cam assembly 50, operating on an arm 53 engaged with the lever 51, in order to provide a switching from a coupling position with the paperboard sheet stack 20 to the position indicated by the broken line, where the paperboard sheet will be released on the paperboard sheet raising conveyor.

On the product supplying or inlet line, generally indicated by the reference number 3, a product delivery device generally indicated by the reference number 60 is moreover provided, said product delivery device operating for arranging the several products being supplied depending on the size thereof, so as to provide a plurality of product rows.

To that end, side bulkhead elements 61 are provided for practically delimitating the product supplying path, said product being indicated generally by the reference letter "P", and usually comprising cans, bottles or other like elements.

Said side bulkheads are driven by a control or adjusting assembly comprising a driving bar 62 pivoted at a middle portion thereof and coupled, by connecting levers 63, arranged symmetrically, to the blocks 64 which are in turn connected to the individual bulkheads 61.

To one end of the bar 62 is pivoted a driving connecting rod 65, in turn coupled to a slider 66 movable on a threaded bar 67, which can be driven by a driving motor.

Thus, as the slider 66 is displaced on the bar 67, it will cause said bar to rotate and, consequently, the bulkheads 61 will be differently arranged, depending on the different distances to be obtained, thereby fitting the assembly to the several products.

At the bottom small conveyor belts are provided, to which is coupled an adjusting system analogous to that provided for the product delivery device.

Downstream of the product delivery device is provided a separating assembly, which can be either of an electronic or of a pneumatic type.

Figure 17:
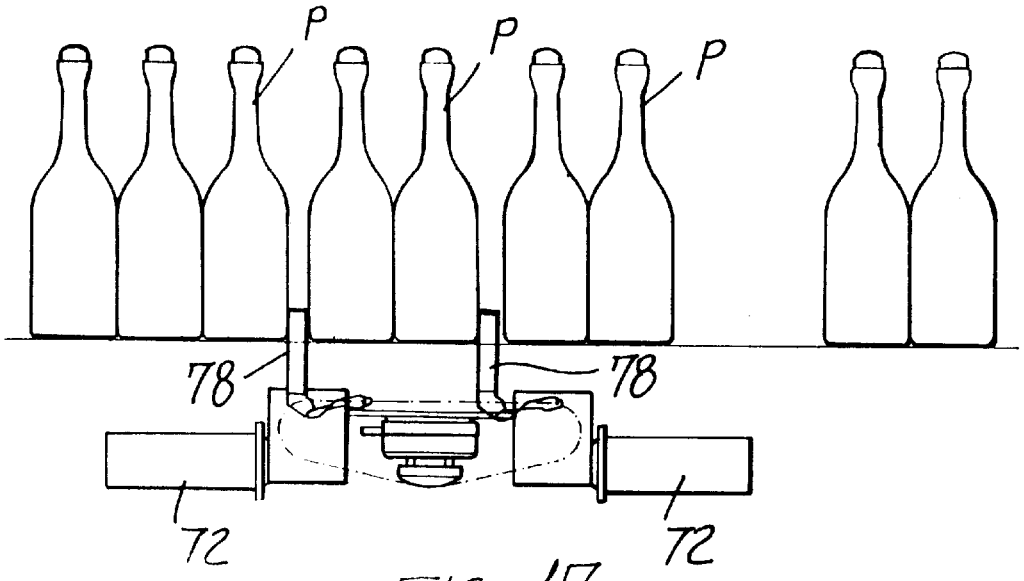
FIG. 17 is a side elevation view illustrating an electronic separating device.
Figure 18:
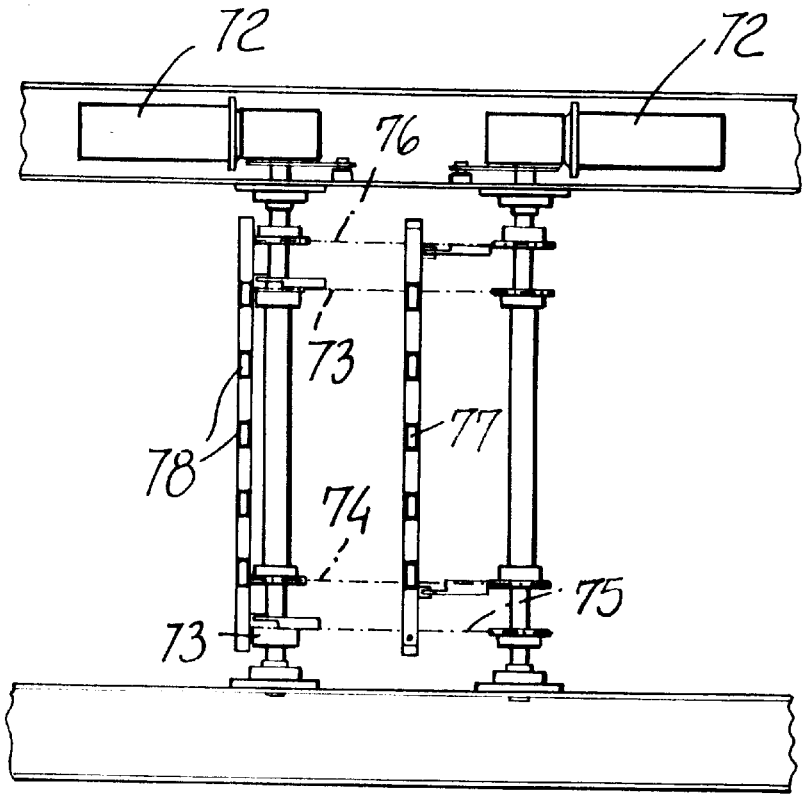
FIG. 18 is a top plan view illustrating the electronic product separating device.

The electronic separating assembly, generally indicated by the reference number 70 and clearly shown in FIG. 17, substantially comprises a first brushless motor 71 and a second brushless motor 72, which brushless motors respectively drive first pinions 73 and second pinions 74.

Said first and second pinions are respectively coupled to a first chain assembly 75 and a second chain assembly 76, entrained on corresponding transmission pinions, said chains respectively supporting separating comb elements 77 and 78 which are driven under a program control to cause the product P separating comb elements to be engaged between the individual product supplying conveyor belts, the conveyed product being stopped upstream of the separating device.

Upon having obtained the desired size, another comb element is engaged for locking an upstream product, whereas the product supported by the small conveyor belts will advance toward the box outlet, while the first comb element will accelerate to reach and stop the upstream product.

All the disclosed procedure is cyclically performed for each pack or assembly of products to be made.

Figure 19:
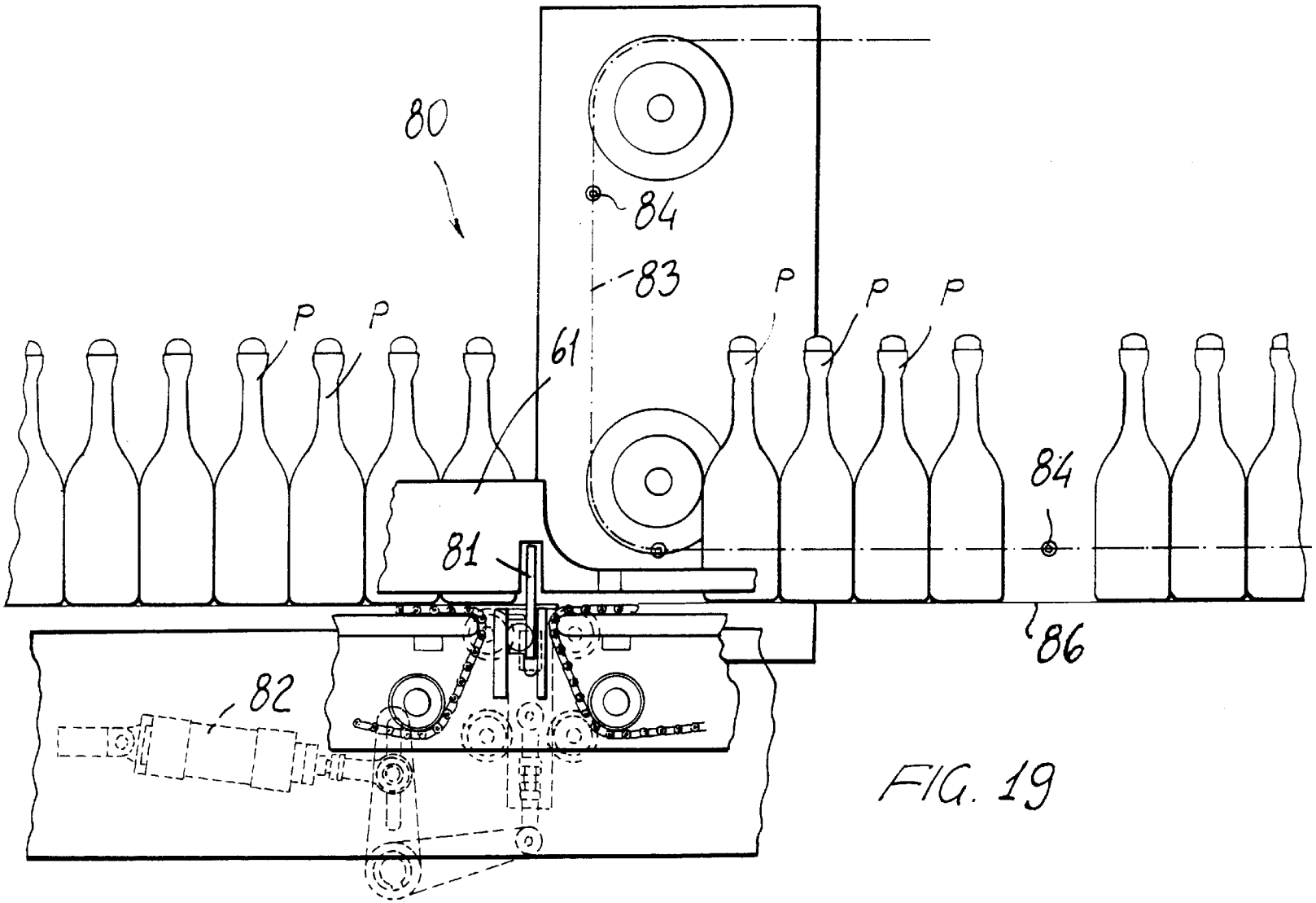
FIG. 19 is a side elevation view illustrating a pneumatic type of product separating device.
Figure 20:
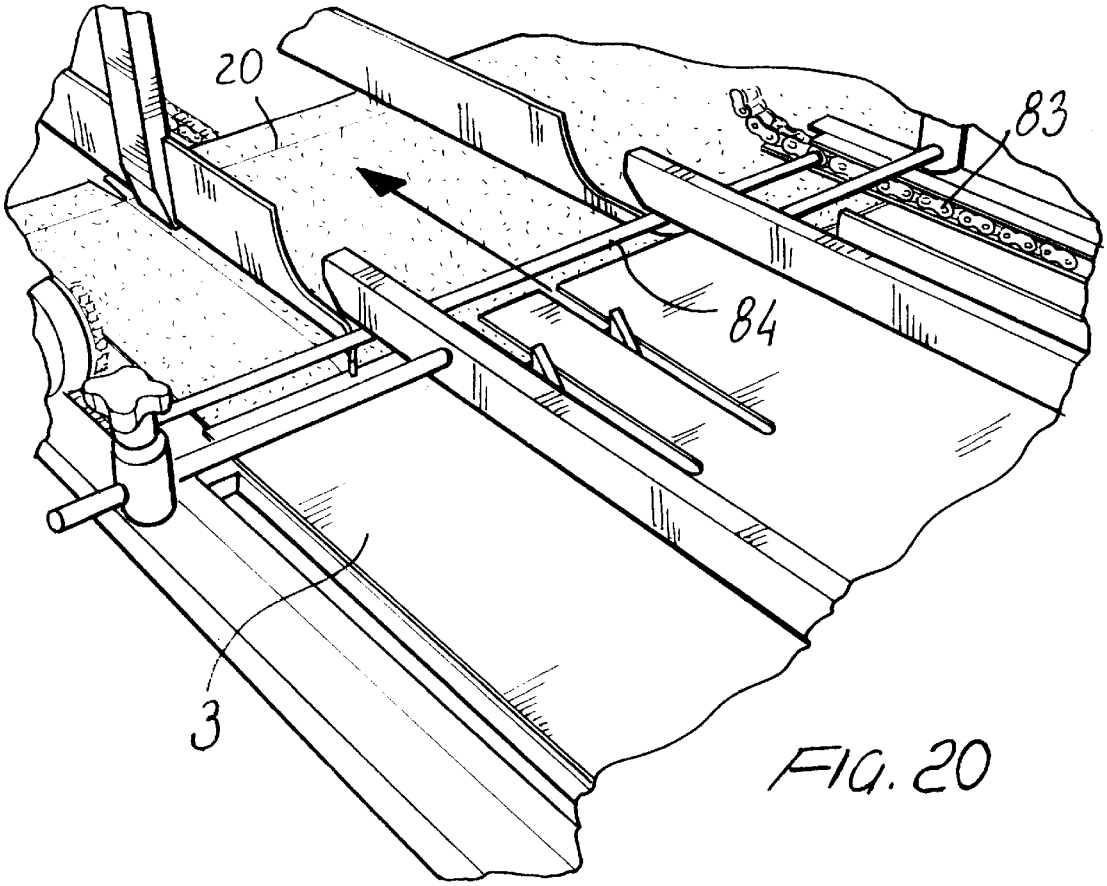
FIG. 20 illustrates an operating step of the apparatus in which paperboard sheets are supplied onto the product supplying or inlet line.
Figure 21:
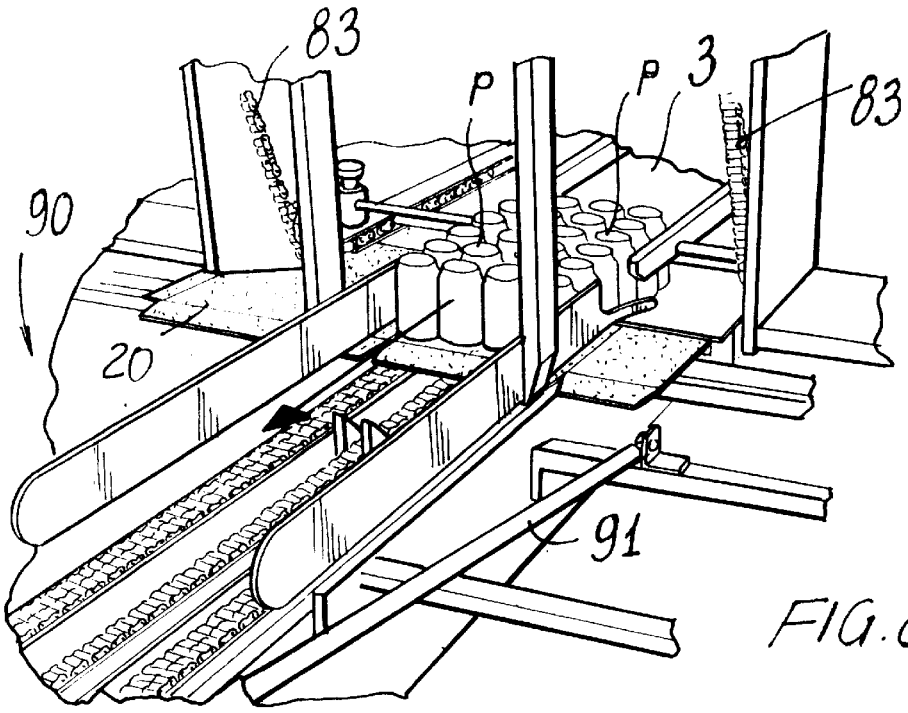
FIG. 21 schematically illustrates another operating step of the packaging apparatus in which a lot of products are arranged on a portion of the paperboard sheet.
Figure 22:
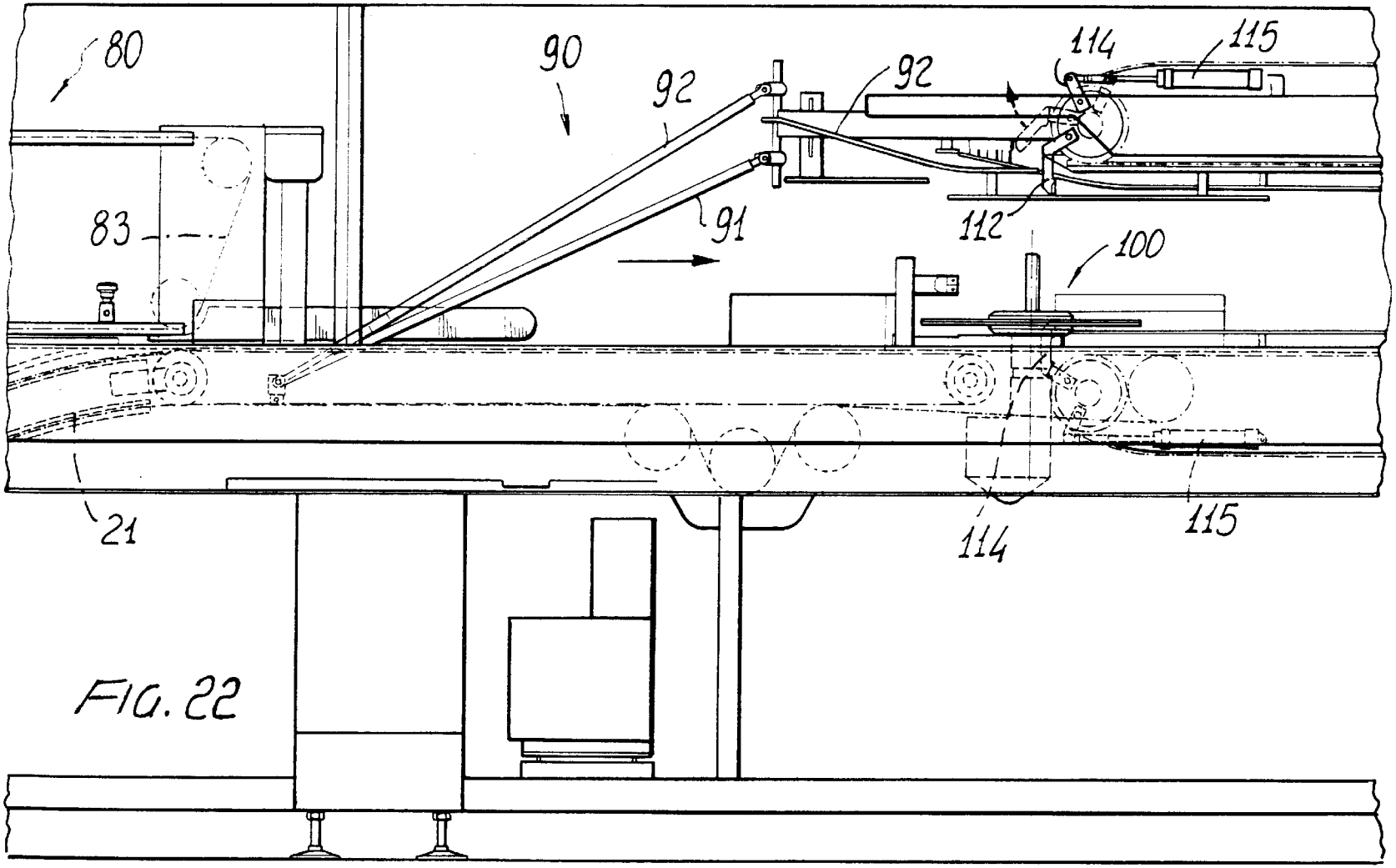
FIG. 22 is a schematic elevation view illustrating a box forming assembly for forming product boxes.
Figure 23:
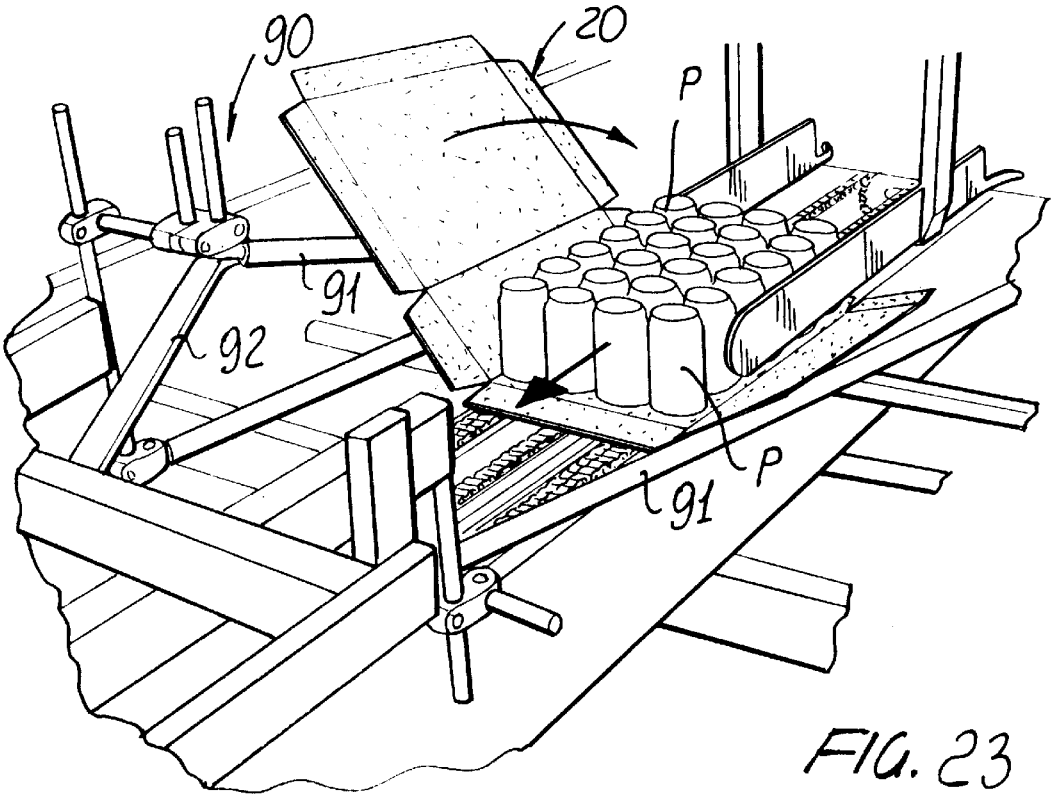
FIG. 23 is a further schematic view illustrating an operating step of the packaging apparatus in which the side panels of the box are bent.
Figure 24:
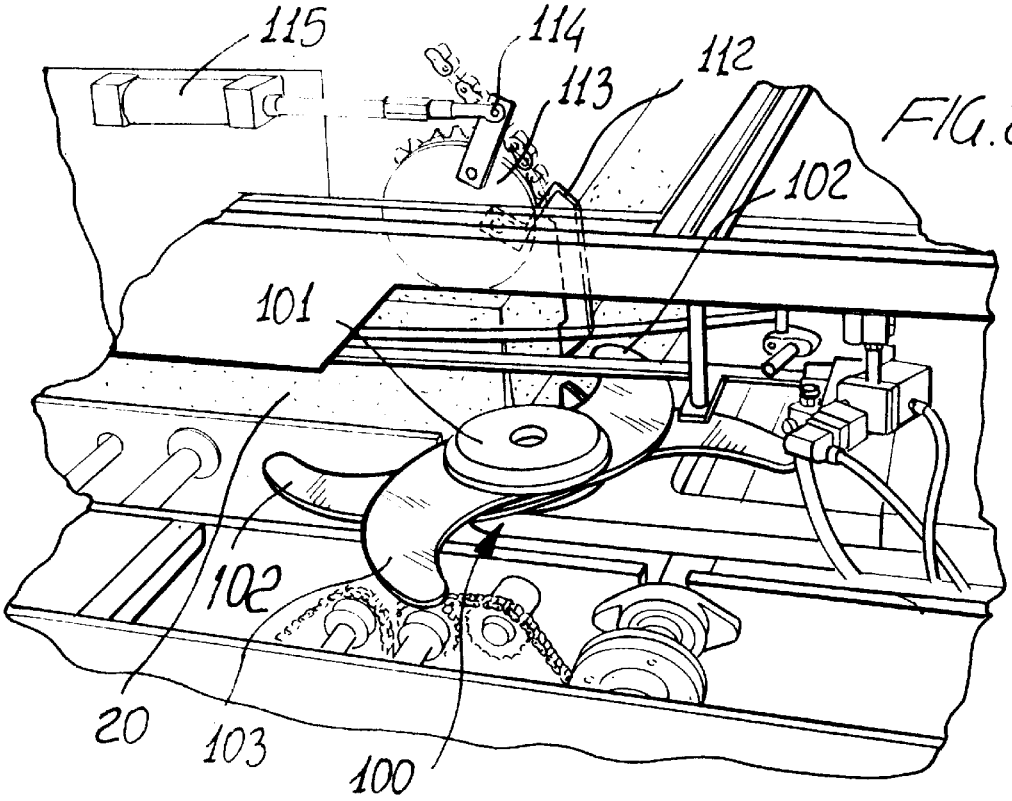
FIG. 24 illustrates a bending device for bending the side flaps as well as the bottom and top flaps.
Figure 25:
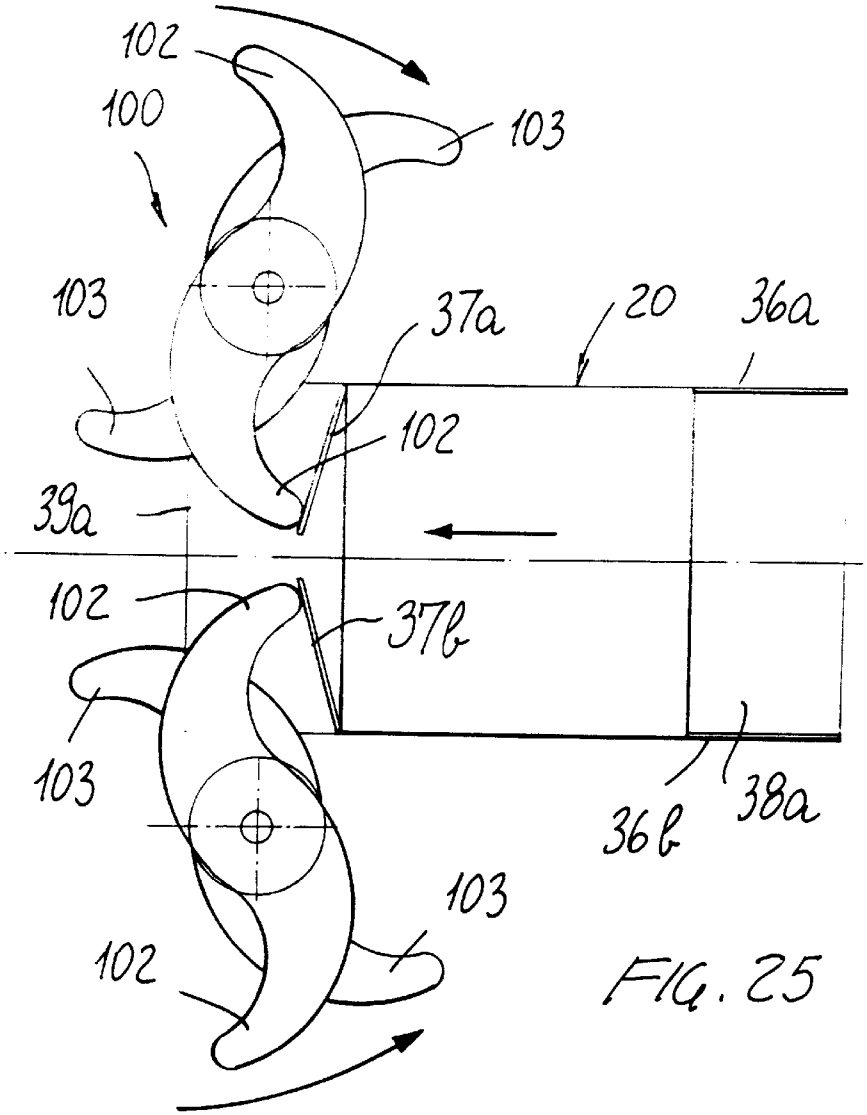
FIG. 25 schematically illustrates an operating step of the packaging apparatus in which the front side flaps are closed.
Figure 26:
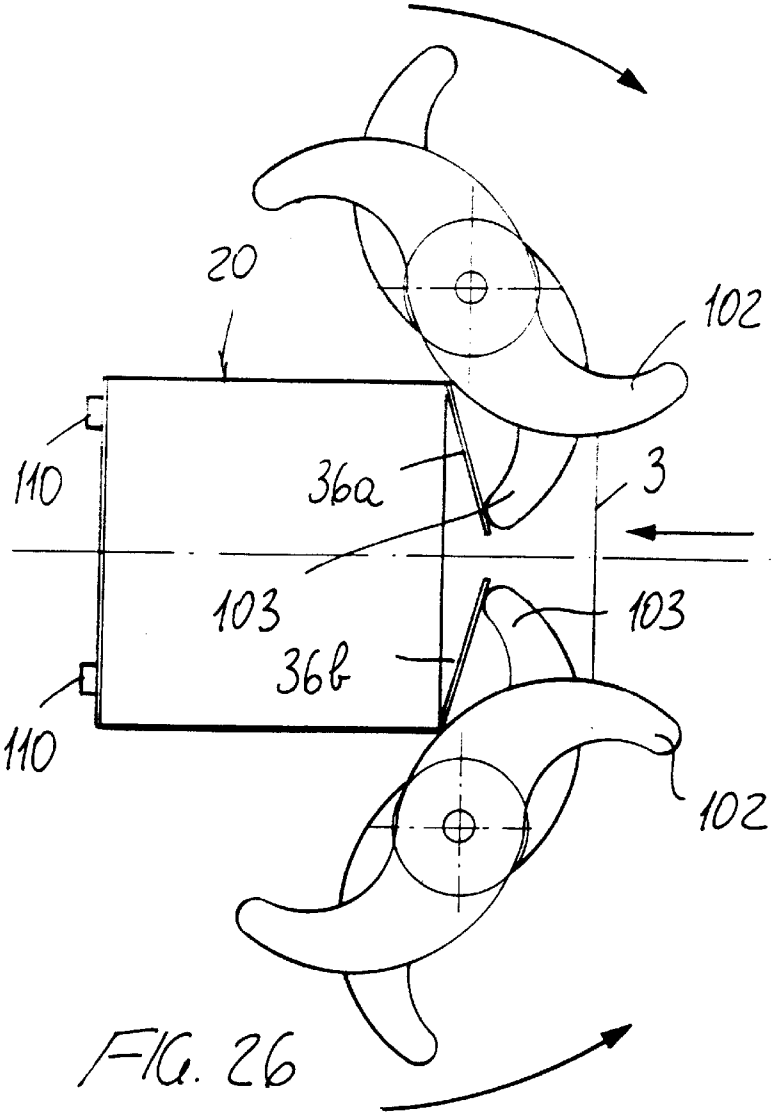
FIG. 26 illustrates a closing operating step for closing the rear side flaps.

FIG. 19 illustrates a pneumatic separating device, generally indicated by the reference number 80, which comprises a stop comb element 81 driven by a pneumatic piston 82, which is actuated for stopping the upstream product P with respect to separating chains 83 continuously extending and supporting a plurality of bars 84.

Thus, the product will be released and caused to rest on one of said bars, thereby stopping the pushing force provided by the inlet conveyor belt.

As the set size is achieved, i.e. the number of products to be packaged, the comb element 81 will be raised to lock the inlet product, whereas the product will advance because of the speed difference between the supplying conveyor belt 86, on which the product are arranged, and the bar 84.

Thus, the bar will be moved away on the front of the product package and will move closer to the rear portion of the preceding package, so as to contact the product and entrain it through the subsequent operating steps.

Said further operating steps practically comprise the coupling with a raising paperboard sheet 20, so as to cause the product to be arranged on the bottom 30 of the paperboard sheet, which is driven in the same direction, thereby immediately arranging the products on the related paperboard sheets.

After having arranged the products on the related paperboard sheet 20, the products arranged on said paperboard sheet are sent to the box forming assembly, generally indicated by the reference number 90, which is provided with side bars 91.

Said side bars are specifically provided for bending the side walls 31 and 32.

Moreover, a top bar, indicated by the reference number 92, for bending the top element, thereby forming the box, is provided.

During a subsequent passage, the side flaps or wings are bent by a side flap bending assembly, indicated by the reference number 100 and made of a disc-like body 101.

From said disc-like body 101 extend pressing elements having a double cycle configuration, indicated by the reference numbers 102 and 103, which owing to the rotary movement about their axes, are so made that the elements 102 will engage with the front side flaps of the box being fed, thereby closing said box.

As the body 101 is rotated, the device will be laterally displaced, so as to allow the box to pass therethrough.

A further rotation will bring the cycle element 103 to engage with the rear side flaps, in a very quick manner.

On the side flaps a glue spry is applied, the glue being deposited on the front flaps and rear flaps and, immediately upon applying the glue, the side flaps are bent, as disclosed thereinabove.

For a timed stopping of the apparatus, upon having bent the side flaps, the front flaps are bent by bending levers 110, and the rear flaps are also bent by bending arms 112 coupled to a disc-like element 113.

The latter is provided with a radially extending lever 114, driven by a piston 115 operating the arms 112 to cause said arms to engage the top and bottom flaps, to cause said flap to be held in contact for a time sufficient for providing a proper closure, whereas, for a normal operation of the apparatus, the front and rear flaps are closed by the front and rear bending arms 110.

In this connection it should be pointed out that it would be possible to provide a further core applying assembly, for introducing between the bottles a protective core.

In the case of an open tray or box, the box is caused to be longitudinally driven, in parallel to the longest side flaps bending lines.

Then, the product will be arranged on the base or bottom of the tray, and the side flaps will be turned through 90°.

Immediately upon having applied the glue spray on the front flaps, the flap bending device is operated in order to transversely bend the flaps through 90° transversely of the flap driving direction, said bending device operating likewise for the rear flaps.

After having closed the front and rear side flaps, the box forming device is operated in order to turn through 90° the base or bottom flaps, i.e. the front and rear flaps, by holding them closed up to the outlet of the apparatus.

From the above disclosure it should be apparent that the invention fully achieves the intended aim and objects.

In particular, the fact is to be pointed out that a packaging apparatus has been disclosed which operates in a very simple manner, with a very reliable operation and a very easy adjustment capability, in order to fit all of the packaging box size which are at present used.

A main advantage of the invention is that it is possible to achieve a very high yield.

Figure 3:
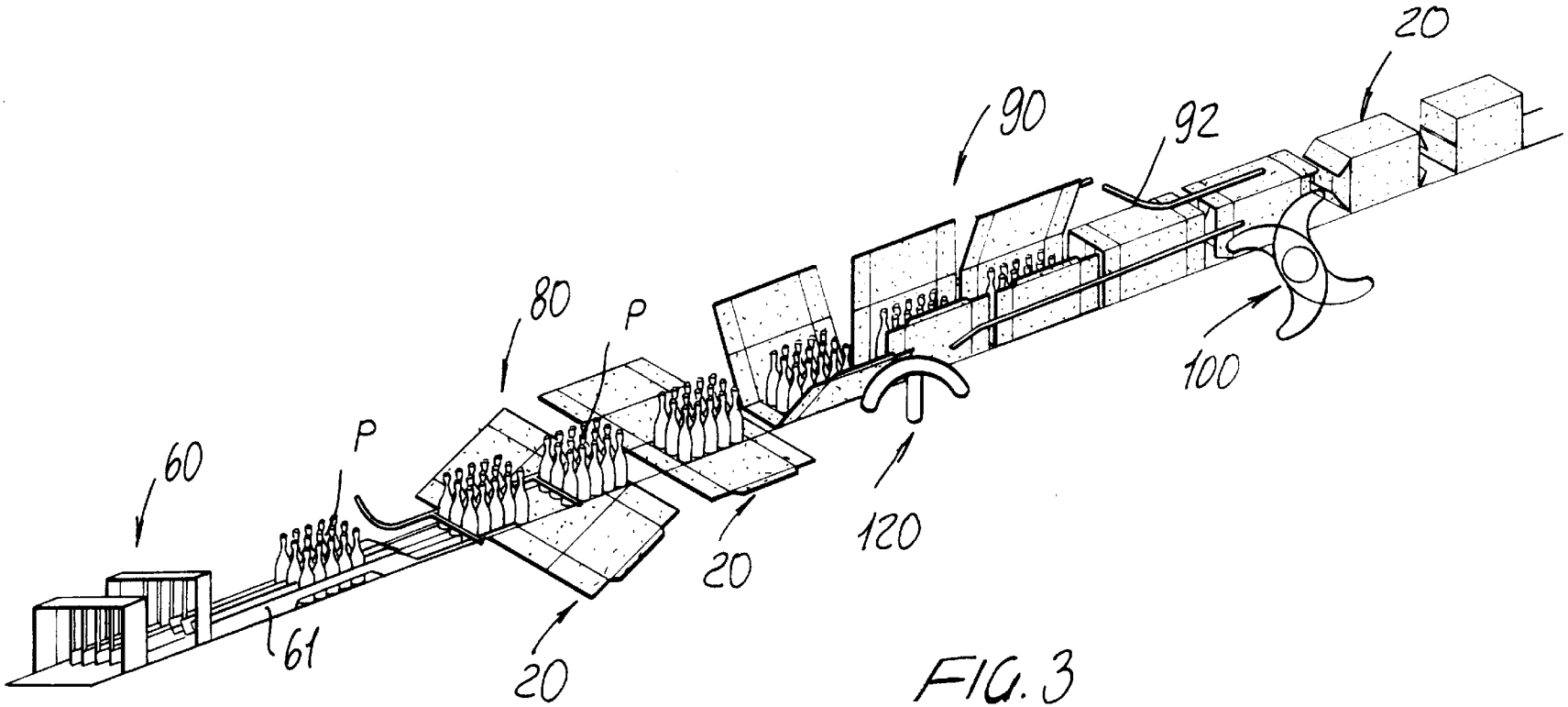
FIG. 3 schematically and sequentially illustrates a different embodiment of the operating steps.

Moreover, it is further possible to use modified embodiments, in order to provide a side bending operation, by using, for example, and as schematically shown in FIG. 3, side pressing elements 120 in order to properly bend the side walls.

While the invention has been disclosed and illustrated with reference to preferred embodiments thereof it should be apparent that the disclosed embodiments are susceptible to many modifications and variations all of which will come within the scope of the appended claims.

I claim:

1. A packaging apparatus for packaging products in an open or closed box having side walls and a top and bottom defined by respective flat paperboard sheets, said packaging apparatus comprising a bearing framework defining on a top portion thereof a product to be packaged supplying line and, at a bottom portion thereof a paperboard sheet removing assembly for successively removing individual paperboard die-cut sheets and supplying said individual sheets to a sheet supplying conveyor communicating with said product to be packaged supplying line, a product to be packaged delivery device and a product separating device receiving said products from said product delivery device, said paperboard sheets being supplied to said line in a supplying direction corresponding to a feeding direction of said products, and a box forming assembly including a flap bending device for bending said side and top and bottom flaps, wherein said product delivery device comprises side bulkhead elements delimiting a product inlet path and driven by an adjusting assembly, comprising a driving bar pivoted at a middle portion thereof and coupled, by symmetrically arranged coupling levers, to supporting blocks which support said individual bulkhead elements, said bar being pivoted at one end thereof to a driving connecting rod, coupled to a slider movable on a transversely arranged threaded bar, said slider, as it is displaced, causing said driving bar to turn with a corresponding displacement of said bulkhead elements.

2. A packaging apparatus according to claim 1, wherein said paperboard sheet removing assembly comprises a paperboard sheet removing device, including a supporting shaft transversely supporting arms provided with end suckers, said supporting shaft being coupled to driving assemblies comprising a driven ring gear coupled to a rotary bushing turning about a first fixed axis parallel to said supporting shaft, said bushing being rigidly coupled to a supporting body rotatably supporting said supporting shaft, thereon is keyed a first pinion, meshing with a second pinion rigid with the first axis, to cause said driving assembly to clockwise rotate and said supporting shaft to anticlockwise rotate.

3. A packaging apparatus according to claim 1, wherein said paperboard sheet removing device comprises a swinging lever pivoted at a top thereof and supporting bottom suckers engageable with a first paperboard sheet of a paperboard sheet stack, a cam assembly including an arm element engaged with said bottom sucker supporting lever, adapted to provide a switching from a coupling position with said paperboard sheet stack to a releasing position in which said paperboard sheet is released on a paperboard sheet raising conveyor being moreover provided.

4. A packaging apparatus according to claim 1, wherein said product separating device comprises an electronic separating assembly including first and second brushless motors, driving respective first and second pinions coupled to first and second chain assemblies, said first chain assembly supporting a first product separating comb element, which can be engaged between said products, and said second chain assembly supporting a second product separating comb element, said first comb element stopping a said product conveyed upstream of said separating device and, as a desired size is achieved, said second comb element being engaged for locking a said upstream product.

5. A packaging apparatus according to claim 1, wherein said product separating device comprises a pneumatic separating device, including an abutment comb element, driven by a pneumatic piston which can be engaged between said products by driving said pneumatic piston perpendicularly to the feeding axis of said products, and a separating chain supporting a plurality of cross bars engaged with closed loop chains to be arranged on the front and on the rear of a separated products group.

6. A packaging apparatus according to claim 1, wherein said box forming assembly comprises a box side wall bending assembly including side bars, for providing said side walls of said box and at least a top bar, for providing said top of said box, as well as side pressing elements, for bending said side walls, wherein said box side walls bending assembly comprises, adjoining a passage region for said sheets, a disc-like body, therefrom extend double cycle pressing elements turning about a rotary axis thereof to engage with a side wall of a box being supplied and to successively engage another side wall of said box.

7. A packaging apparatus according to claim 1, wherein said packaging apparatus further comprises a glue spraying assembly for spraying glue on said box side walls, before bending said top and bottom of said box, and bending levers for bending said front, top and bottom walls as well as bending arms coupled to a disc-like element including a radially extending lever driven by a piston driving said bending arms to cause said bending arms to engage with said top and bottom of said box, to allow said glue to cure.

* * * * *